US009713876B2

(12) United States Patent
Brada et al.

(10) Patent No.: US 9,713,876 B2
(45) Date of Patent: Jul. 25, 2017

(54) SHAVING DEVICE WITH IMPROVED CONTOUR FOLLOWING

(71) Applicant: KONINKLIJKE PHILIPS N.V., Eindhoven (NL)

(72) Inventors: Ype Brada, Eindhoven (NL); Oege Smedinga, Eindhoven (NL); Sint Baron, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/968,992

(22) Filed: Dec. 15, 2015

(65) Prior Publication Data

US 2016/0199987 A1 Jul. 14, 2016

Related U.S. Application Data

(63) Continuation of application No. 13/202,651, filed as application No. PCT/IB2010/050890 on Mar. 2, 2010, now Pat. No. 9,216,513.

(30) Foreign Application Priority Data

Mar. 9, 2009 (EP) ..... 09154650

(51) Int. Cl.
*B26B 19/14* (2006.01)

(52) U.S. Cl.
CPC ..... *B26B 19/14* (2013.01); *B26B 19/143* (2013.01); *B26B 19/145* (2013.01); *B26B 19/146* (2013.01)

(58) Field of Classification Search
CPC ..... B26B 19/14; B26B 19/141; B26B 19/143; B26B 19/145; B26B 19/146; B26B 19/386
USPC ..... 30/43.3–43.92; D28/44.1, 49–54
See application file for complete search history.

(56) References Cited

U.S. PATENT DOCUMENTS

| | | | | |
|---|---|---|---|---|
| 3,715,803 A | | 2/1973 | Tyler | |
| 4,168,570 A | | 9/1979 | Bakker | |
| 5,625,950 A | | 5/1997 | Sterk | |
| D424,746 S | * | 5/2000 | Lee | D28/50 |
| D469,219 S | * | 1/2003 | McLachlan | D28/50 |
| D495,092 S | * | 8/2004 | Massee | D28/50 |
| D502,784 S | * | 3/2005 | Micinilio | D28/50 |

(Continued)

FOREIGN PATENT DOCUMENTS

| | | | |
|---|---|---|---|
| CA | 2754676 A1 | * | 9/2010 |
| CN | 2411880 Y | | 12/2000 |

(Continued)

*Primary Examiner* — Jason Daniel Prone

(57) ABSTRACT

A shaving head includes at least one cutting unit in which an external cutting member is subjected to a shaving action. The external cutting member is suspended relative to a holder of the shaving head through suspension means. The suspension means includes at least two pivot constructions, wherein one pivot construction enables a member of the suspension means to be pivotable relative to the holder. The other pivot construction enables the external cutting member to be pivotable relative to the suspension member. Furthermore, a pivoting stiffness of a connection of the latter pivot construction is lower than a pivoting stiffness of the first pivot construction. In this manner, good contour following performance is obtained at two levels, in both relatively small and relatively large curvature changing areas.

13 Claims, 5 Drawing Sheets

(56) References Cited

U.S. PATENT DOCUMENTS

D506,037 S * 6/2005 Massee ..... D28/50
D539,475 S * 3/2007 Dingelstad ..... D28/50
D539,476 S * 3/2007 Dingelstad ..... D28/50
D539,477 S * 3/2007 Dingelstad ..... D28/50
D542,473 S * 5/2007 McLachlan ..... D28/50
D544,999 S * 6/2007 Prat-Pfister ..... D28/50
D546,001 S * 7/2007 McLachlan ..... D28/50
D549,873 S * 8/2007 Prat-Pfister ..... D28/50
D550,901 S * 9/2007 Massee ..... D28/50
D563,599 S * 3/2008 Prat-Pfister ..... D28/50
D601,301 S * 9/2009 Bao ..... D28/50
7,584,541 B2 9/2009 Uchiyama
D619,766 S * 7/2010 Nitz ..... D28/50
D620,198 S * 7/2010 Nitz ..... D28/50
D620,641 S * 7/2010 Nitz ..... D28/50
D620,642 S * 7/2010 Nitz ..... D28/50
7,930,828 B2 4/2011 Brada
D637,759 S * 5/2011 Byun ..... D28/50
D651,746 S * 1/2012 Prat-Pfister ..... D28/50
D654,223 S * 2/2012 Aulwes ..... D28/50
D663,897 S * 7/2012 Aulwes ..... D28/54
8,261,452 B2 9/2012 Westerhof
8,296,954 B2 10/2012 Schneider
D672,504 S * 12/2012 Lyles ..... D28/50
8,336,211 B2 12/2012 De Wit
D675,779 S * 2/2013 Vetu ..... D28/50
8,393,082 B2 * 3/2013 Shimizu ..... B26B 19/14 30/43.5
D693,060 S * 11/2013 Lyles ..... D28/50
D695,961 S * 12/2013 Prat-Pfister ..... D28/50
D695,962 S * 12/2013 Prat-Pfister ..... D28/50
8,844,141 B2 * 9/2014 Van Der Borst ..... B26B 19/14 30/43.4
D721,204 S * 1/2015 Prat-Pfister ..... D28/50
9,009,978 B2 * 4/2015 Schneider ..... B26B 19/14 30/43.4
9,027,251 B2 * 5/2015 Schmitt ..... B26B 19/14 30/43.4
D737,514 S * 8/2015 Roland ..... D28/50
D737,515 S * 8/2015 Roland ..... D28/50
D737,516 S * 8/2015 Roland ..... D28/50
D738,042 S * 9/2015 Roland ..... D28/50
9,216,513 B2 * 12/2015 Brada ..... B26B 19/14 30/43.6
D748,857 S * 2/2016 Boulanger ..... D28/50
D758,014 S * 5/2016 Smith ..... D28/50
D758,659 S * 6/2016 Smith ..... D28/50
2004/0128834 A1 7/2004 Royle
2004/0231160 A1 11/2004 Shiba
2004/0237310 A1 12/2004 Shiba
2007/0124936 A1 6/2007 Okabe
2007/0256302 A1 * 11/2007 Okabe ..... B26B 19/141 30/43.6
2007/0277379 A1 12/2007 Okabe
2008/0034591 A1 2/2008 Fung
2009/0092393 A1 4/2009 Xu et al.
2009/0165305 A1 7/2009 Kraus
2010/0011589 A1 1/2010 Van Der Borst
2012/0227266 A1 * 9/2012 Meijer ..... B26B 19/14 30/41.6
2015/0013167 A1 * 1/2015 Shen ..... B26B 19/14 30/43.6
2015/0224654 A1 * 8/2015 Steur ..... B26B 19/145 30/43.6
2015/0343652 A1 * 12/2015 Mimura ..... B26B 19/141 30/43.6
2016/0052153 A1 * 2/2016 Oosterhoff ..... B26B 19/146 30/43.6
2016/0082607 A1 * 3/2016 Shimizu ..... B26B 19/143 30/43.6
2016/0089799 A1 * 3/2016 Mimura ..... B26B 19/143 30/43.6
2016/0236360 A1 * 8/2016 Veltman ..... B26B 19/388 30/43.6
2016/0297084 A1 * 10/2016 Winters ..... B26B 19/3853 30/43.6

FOREIGN PATENT DOCUMENTS

EP 1405701 A1 4/2004
EP 1862271 A1 12/2007
EP 1935585 A1 6/2008
EP 2406042 B1 * 5/2014
GB 2266080 A 10/1993
JP 2015091511 A * 5/2015
WO 2006067721 A1 6/2006
WO WO 2006067710 A1 * 6/2006
WO 2008010139 A1 1/2008
WO WO 2010103425 A1 * 9/2010

* cited by examiner

SHAVING DEVICE WITH IMPROVED CONTOUR FOLLOWING

This patent application is a continuation of co-pending U.S. patent application Ser. No. 13/202,651, now U.S. Pat. No. 9,216,513, filed on Aug. 22, 2011 which is a U.S. National Phase application under 35 U.S.C. §371 of International Application No. PCT/IB2010/050890, filed on Mar. 2, 2010, which claims the benefit of International Application No. 09154650.7 filed on Mar. 9, 2009. These applications are hereby incorporated by reference herein.

FIELD OF THE INVENTION

The present invention relates to a shaving head for use in a shaving device for removing hairs from skin by cutting through the hairs, comprising at least one cutting unit, and a holder for holding the cutting unit, which holder is intended to be mounted on a body portion of the shaving device, which body portion is intended to be taken hold of by a user of the shaving device, and serves for accommodating various members of the shaving device, wherein the cutting unit comprises an external cutting member having a surface which is intended for contacting skin during a shaving action, and which is interrupted by openings for allowing hairs to pass, wherein the cutting unit further comprises an internal cutting member which is drivable for movement along the openings in the surface of the external cutting member, and which is adapted to cut through hairs during such movement, wherein the external cutting member is suspended relative to the holder through suspension means comprising:

a suspension member, and a pivot construction by means of which the suspension member is pivotable relative to the holder.

Furthermore, the present invention relates to a shaving device for removing hairs from skin by cutting through the hairs, comprising a body portion which is intended to be taken hold of by a user of the shaving device, and which serves for accommodating various members of the shaving device, and a shaving head as mentioned.

BACKGROUND OF THE INVENTION

An example of a shaving device comprising a body portion, and a shaving head having at least one cutting unit and a holder as described above is known from WO 2006/067721. The shaving device is a so-called rotary shaving device, i.e. a shaving device in which the internal cutting member comprises a ring-shaped support portion which is provided with a number of cutting blades, wherein the support portion is driven such as to rotate during operation of the shaving device. In the example known from WO 2006/067721, the shaving head of the shaving device is equipped with three cutting units. The external cutting member of the cutting units is shaped like a cap which serves for covering the internal cutting member, which is intended to be used for contacting portions of skin to be subjected to a shaving action, and which is provided with openings for letting through hairs from the portions of skin to the cutting blades of the internal cutting member. It is understood that a main function of the external cutting member is avoiding direct contact between the cutting blades of the internal cutting member and the portions of skin, so that skin damage is prevented.

The shaving device comprises means such as a motor for driving the internal cutting members. Proper use of the shaving device involves movement of the shaving device in such a way that a surface of the external cutting members glides over portions of skin. In the process, hairs protruding from the skin are continuously caught in the openings of the external cutting members and are cut through as soon as they are encountered by the moving cutting blades of the internal cutting members, wherein edges of the openings of the external cutting member serve as counter cutting edges.

In each of the cutting units, the external cutting member is suspended relative to the holder through a suspension member. The suspension member has a generally circular shape, and is tiltable relative to the holder about a tilting axis. The three cutting units are arranged in a symmetrical configuration about a central axis, and means for driving the internal cutting members of the cutting units comprise a central drive shaft, a gear wheel arranged on the drive shaft, and a gear wheel per cutting unit. The central gear wheel is arranged such as to engage all three gear wheels of the cutting units and drive these gear wheels. The tilting axes of the suspension members of the cutting units extend in an area where the gear wheels of the cutting members engage the central gear wheel, i.e. in an area closer to the circumference of the cutting units than to a central position.

Although the use of the shaving device known from WO 2006/067721 yields good shaving results, there is a need for further improvement. A number of disadvantages appear to be associated with the shaving device. For example, when the shaving device is applied for a shaving action on the face, following the facial contours involves tilting movements of the suspension members of the cutting units about their tilting axes. In the process, it appears that a reaction on the skin involves a sliding effect, which results in frequently changing stretching and compressing of the skin. Furthermore, there appears to be a non-uniform skin pressure distribution between skin and cutting units. Also, it is only possible to closely follow purely convex and concave contours.

SUMMARY OF THE INVENTION

It is an object of the present invention to improve the shaving results and the feel experienced by a user of the shaving device by eliminating the above-mentioned disadvantages. The object is achieved by providing a shaving head in which the means for suspending the external cutting member relative to the holder of the shaving head comprise a second pivot construction, by means of which the external cutting member is pivotable relative to the suspension member, in addition to the suspension member and the first pivot construction by means of which the suspension member is pivotable relative to the holder, wherein a pivoting stiffness of the second pivot construction is lower than a pivoting stiffness of the first pivot construction.

For the sake of clarity, it is noted that the pivoting stiffness is directly related to a tilting momentum that is needed to realize a defined tilting angle in a pivot construction. The higher the tilting momentum needed to realize a defined tilting angle, the higher the pivoting stiffness. This may be realized on the basis of a steeper relation between the tilting momentum and the tilting angle, but it is also possible that there is a threshold value of the tilting momentum, which needs to be exerted before a tilting movement and a tilting angle may actually be realized. In such a case, according to the present invention, the threshold value as mentioned is lower for the second pivot construction than for the first pivot construction. The possibility of having a threshold value of the tilting momentum may also be denoted as prestress in a pivot connection, wherein a pivoting stiffness is higher when it takes a higher momentum to move a pivotably arranged member from a default rest position.

In comparison with the shaving head of the shaving device known from WO 2006/067721, the at least one cutting unit of the shaving head according to the present invention does not only comprise a first pivot construction for realizing a pivoting arrangement of the suspension member with respect to the holder, but also a second pivot construction for realizing a pivoting arrangement of the external cutting member with respect to the suspension member.

Within the scope of the present invention, the number of pivot constructions of the suspension means may be any desired number. In a practical embodiment of the shaving head according to the present invention, there may be at least one additional suspension member besides the suspension member which is located at the side of the holder. In the following, for the sake of clarity, the suspension member which is located at the side of the holder will be denoted as basic suspension member. In case the suspension means comprise two or more suspension members, the suspension member which is located at the side of the external cutting member will be denoted as end suspension member, and any other suspension member, besides the basic suspension member and the end suspension member, will be denoted as intermediate suspension member.

For example, the suspension means of the shaving head according to the present invention may comprise two suspension members, wherein the end suspension member is pivotable relative to the basic suspension member by means of the second pivot construction as defined in the foregoing. According to another possibility existing within the scope of the present invention, there are three pivot constructions and two suspension members in the suspension means, wherein the end suspension member is pivotable relative to the basic suspension member by means of the second pivot construction, wherein the external cutting member is pivotable relative to the end suspension member by means of a third pivot construction, and wherein both the pivoting stiffness of the second pivot construction and a pivoting stiffness of the third pivot construction are lower than the pivoting stiffness of the first pivot construction.

In any case, having suspension means comprising at least two pivot constructions makes it possible to have a tilting axis which has a more or less central position in the cutting unit, and which is relatively close to skin level. Hence, the application of at least one additional pivot construction may solve most of the problems as mentioned in the foregoing, particularly the sliding effect on the skin and the non-uniform pressure distribution on the cutting unit. Furthermore, the contour following capability of the cutting unit is improved to an unexpectedly large extent by making sure that a pivoting stiffness of a pivot construction other than the first pivot construction is lower than a pivoting stiffness of the first pivot construction. An explanation can be found in the observation that a momentum which is needed to rotate a member suspended with low pivoting stiffness is lower than a momentum which is needed to rotate a member with high pivoting stiffness, so that it is possible to have both good contour following capabilities in an area of relatively small curvature changes, such as within the cheek or neck area of a user's skin, and good contour following capabilities in an area of larger curvature changes, such as between cheek and neck area.

All in all, when the present invention is applied, contour following is improved to a surprisingly large extent. Furthermore, it is possible to realize a situation in which necessary skin pressure for optimal shaving performance of a shaving device is less user-dependent. Also, sensitivity to friction between skin and cutting unit may be relatively low when the tilting axis of the at least one additional pivot construction extends close to or at skin level, and more uniform skin contact may be obtained when the tilting axes of the various pivot constructions extend in mutually different directions.

In a practical embodiment of the shaving head according to the present invention comprising at least two suspension members, the suspension members may comprise rings which are connected to each other in a concentric arrangement at two places defining a tilting axis of the suspension members with respect to each other. In other words, the suspension members may be interconnected in a kind of cardanic arrangement. Having the suspension members in such an arrangement is a very practical manner of realizing desired tilting axes and degrees of freedom in the suspension of the external cutting member and the associated internal cutting member.

It is possible for the end suspension member to cover at least a portion of the other suspension member(s). An advantage of such a configuration is that the feel of the cutting units may be improved, assuming a situation in which the external cutting member is surrounded by the various suspension members. In such a situation, on the basis of a covering function of the end suspension member, it is achieved that a user of the shaving device comprising the shaving head according to the present invention experiences a smooth surface rather than a surface in which transitions between various suspension members are present.

The present invention is very well applicable in the field of rotary shaving devices, i.e. shaving devices in which the at least one internal cutting member is rotatably arranged. However, that does not alter the fact that types of movement of the internal cutting member other than a rotary movement are feasible within the scope of the present invention.

The above-described and other aspects of the present invention will be apparent from and elucidated with reference to the following detailed description of a shaving device and shaving heads for use in a shaving device, particularly cutting units of the shaving heads.

BRIEF DESCRIPTION OF THE DRAWINGS

The present invention will now be explained in greater detail with reference to the Figures, in which equal or similar parts are indicated by the same reference signs, and in which.

DETAILED DESCRIPTION OF EMBODIMENTS

Figure 1:
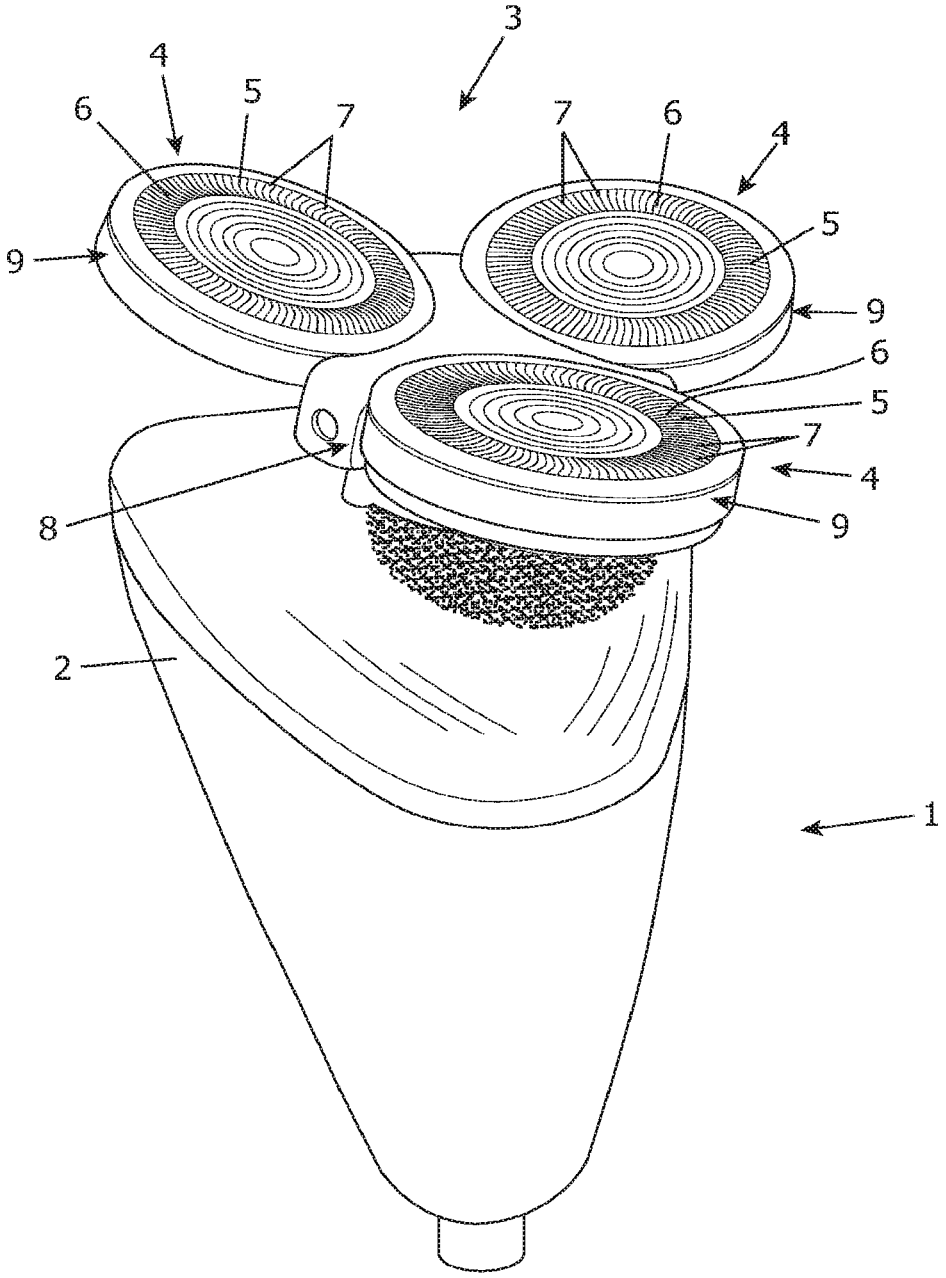
FIG. 1 PRIOR ART
FIG. 1 diagrammatically shows a perspective view of a shaving device known per se.

FIG. 1 shows a conventional shaving device 1 such as known from WO 2006/067721. The shaving device 1 is a rotary shaving device in which a shaving action is realized by using rotating components. Another well-known type of shaving device is a device in which a shaving action is realized by using reciprocating components. For the sake of completeness, it is noted that the present invention is applicable in various types of shaving devices.

The shaving device 1 comprises a body portion 2 and a shaving head 3 in which a number of cutting units 4 are located. The body portion 2 is intended to be taken hold of by a user of the shaving device 1, while the cutting units 4 are intended to be positioned against skin which is to be subjected to a shaving action, for actually performing a shaving action. In the shown example, the shaving head 3 has three cutting units 4.

Each cutting unit 4 comprises an external cutting member 5 which is shaped like a cap having an external skin contacting surface 6 and openings 7 for letting through hairs to an inside of the cutting unit 4, and an internal cutting member (not shown) having a number of cutting blades which are positioned in an inside space of the cutting unit 4 on a suitable support portion, and which are adapted to cut off the hairs. During operation of the shaving device 1, the support portion having the cutting blades is driven such as to rotate. To this end, the shaving device 1 may be equipped with any suitable driving means (not shown) such as a small electric motor.

The operation of a shaving device 1 comprising a shaving head 3 having one or more cutting units 4, wherein each of the cutting units 4 comprises an external cutting member 5 and an internal cutting member as described in the foregoing, is as follows. When the shaving device 1 is used for performing a shaving action, the external cutting members 5 are moved across a portion of skin to be subjected to the shaving action by a user of the shaving device 1, and the internal cutting members are driven such as to rotate at their position right behind the external cutting members 5. Due to the movement of the cutting units 4 with respect to the skin, there is a continuous process of hairs getting trapped inside the openings 7 of the external cutting members 5 and being encountered by the cutting blades of the internal cutting members, as a result of which the hairs are cut through.

The shaving device 1 comprises a holder 8 for holding the cutting units 4 and mounting the shaving head 3 on the body portion 2. Furthermore, in the conventional situation as illustrated in FIG. 1, each of the cutting units 4 comprises a suspension ring 9 for realizing a pivot connection between the external cutting member 5 and the holder 8, wherein a tilting axis extends in a circumferential area of the cutting unit 4, at a side of the cutting unit 4 which is near a central axis of the shaving head 3. By having the tilting axis in a structure extending from the body portion 2 to the external cutting member 5, the external cutting member 5 and the associated internal cutting member are allowed to follow a given curvature of skin to be subjected to a shaving action.

Figure 2:
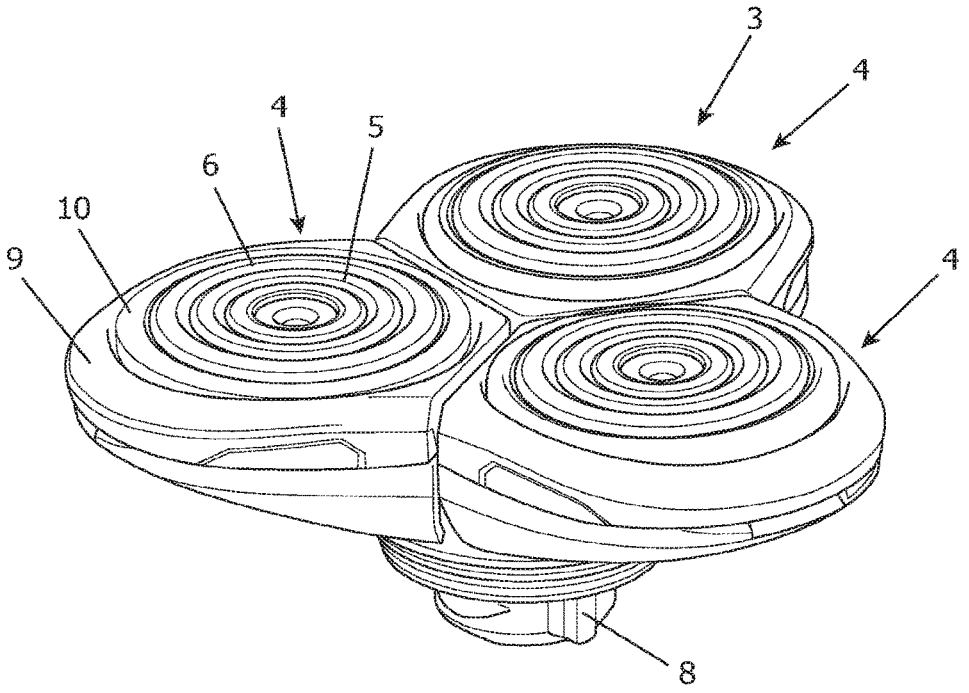
FIG. 2 diagrammatically shows a perspective view of a shaving head according to the present invention.

The present invention relates to the way in which the external cutting members 5 of the cutting units 4 are suspended relative to the holder 8. FIG. 2 shows an embodiment of a shaving head 3 according to the present invention. In comparison with the conventional situation, each cutting unit 4 comprises two suspension rings 9, 10 instead of just one. In particular, there is a basic suspension ring 9 which is comparable to the suspension ring 9 which is present in the conventional situation. This basic suspension ring 9 is an outer ring which is tiltable about a tilting axis located in a circumferential area of the cutting unit 4. Inside the basic suspension ring 9, in a concentric arrangement, another suspension ring 10 is arranged, and in this suspension ring 10 the external cutting member 5 is arranged. The basic suspension ring 9 is pivotably connected to the holder 8, and the additional suspension ring 10, which is also denoted as end suspension ring 10, is pivotably connected to the basic suspension ring 9.

Figure 3:
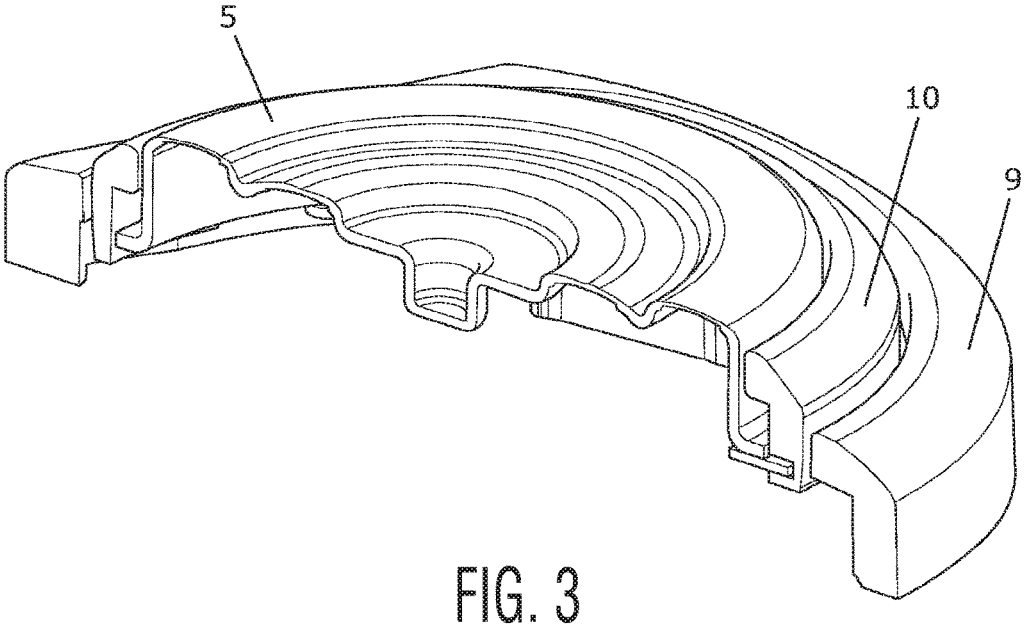
FIG. 3 diagrammatically shows a perspective view of a section of a cutting unit of a shaving head according to the present invention.

In FIG. 3, the configuration of the external cutting member 5 and the suspension rings 9, 10 is clearly illustrated. In the concentric arrangement as mentioned, the suspension rings 9, 10 are connected to each other at two places which are located on an imaginary straight line intersecting the centre of the concentric arrangement, and in this way, the pivot connection between the suspension rings 9, 10 is obtained. For the sake of completeness, it is noted that in the diagrammatic depiction in FIG. 3, details like the openings 7 in the skin contacting surface 6 of the external cutting member 5 are not shown.

Figure 4:
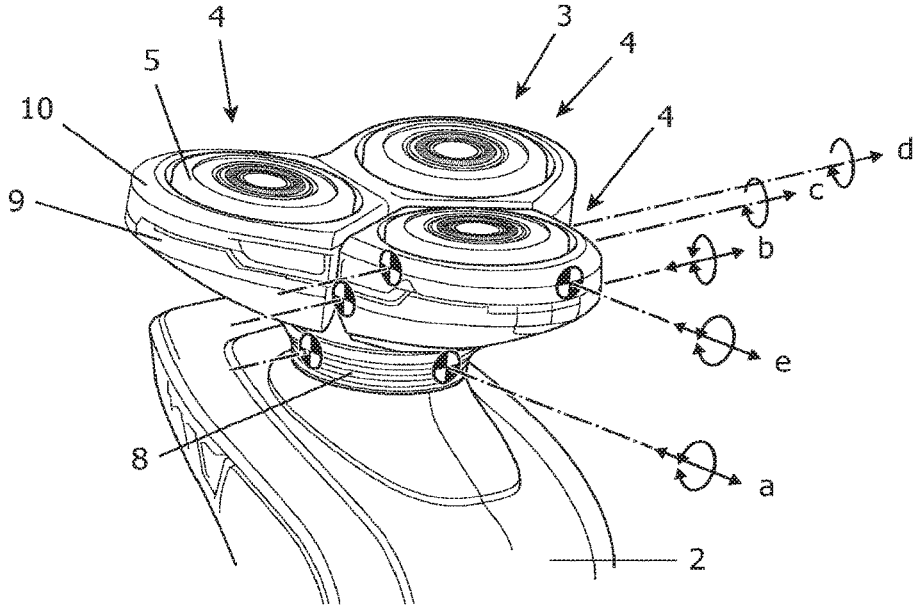
FIGS. 4 and 10 illustrate the degrees of freedom of a movement of a cutting unit of a shaving head according to the present invention.
Figure 10:
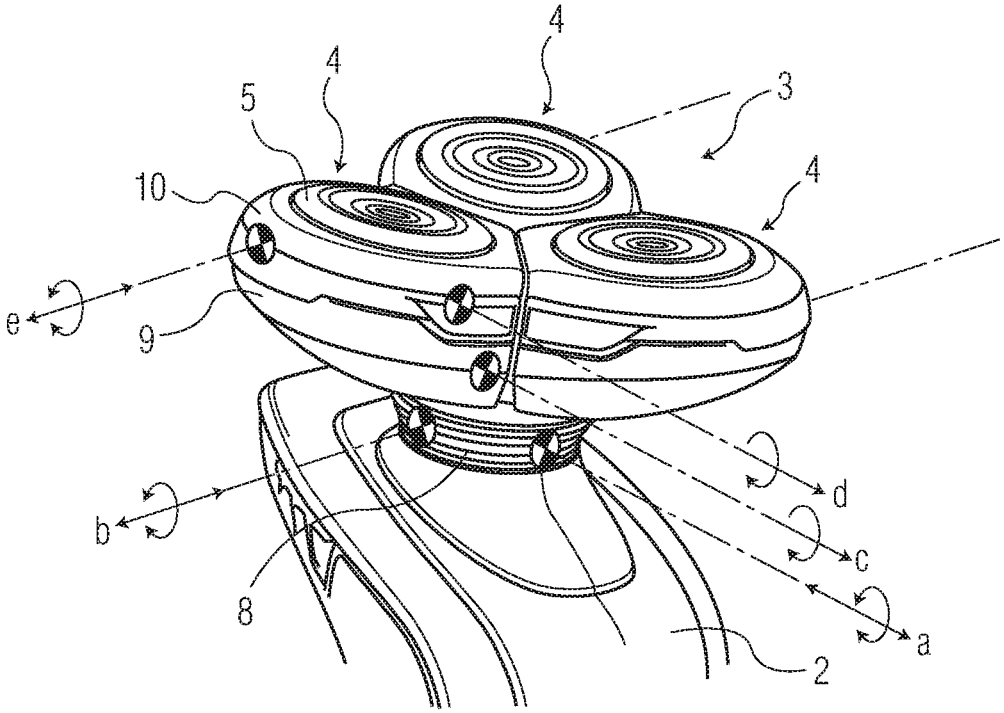

FIGS. 4 and 10 serve to illustrate the various degrees of freedom of movement of a cutting unit 4, which are obtained when at least one additional suspension ring 10 is applied for suspending the external cutting member 5 relative to the holder 8. In the first place, the holder 8 is adapted to allow for rotational movements with respect to the body portion 2, which is only partially shown in FIGS. 4 and 10, about two perpendicular tilting axes a, b. In the second place, the basic suspension ring 9 is tiltable with respect to the holder 8 about a tilting axis c. In the shown example, this tilting axis c extends substantially parallel to one of the tilting axes a, b of the holder 8. In the third place, the end suspension ring 10 is tiltable with respect to the basic suspension ring 9 about a tilting axis d, which, in the shown example, extends substantially parallel to the tilting axis c of the basic suspension ring 9 and one of the tilting axes a, b of the holder 8. Furthermore, FIGS. 4 and 10 clearly show that, in the shown example, the tilting axis c of the basic suspension ring 9 has an off-centre position with respect to the cutting unit 4 and the external cutting member 5, whereas the relative position as mentioned of the tilting axis d of the end suspension ring 10 is a central one. In the fourth place, the external cutting member 5 is tiltable with respect to the end suspension ring 10 about a tilting axis e, which, in the shown example, extends perpendicularly to the tilting axes c, d of the suspensions rings 9, 10.

In view of the overall construction of the shaving device 1 and the desired application of the shaving device 1, it will be understood that there is only a need for tilting movements of the holder 8 and the suspension rings 9, 10 in limited ranges. For example, the tilting movements of the holder 8 may be in a range of 10° in two opposite rotational directions, starting from a default position of the holder 8, and the tilting movements of the basic suspension ring 9 may be in a range of 10° in only one rotational direction, starting from a default position of the basic suspension ring 9, and the tilting movements of the end suspension ring 10 may be in a range of 7° in two opposite rotational directions, starting from a default position of the end suspension ring 10.

In the shaving device 1 according to the present invention, the extent to which the contours of skin to be subjected to a shaving action can be followed is improved. In this respect, it is noted that an important feature of the suspension configuration in which at least two members 9, 10 which are tiltable with respect to each other are present is that a stiffness of the pivot connection of the suspension members 9, 10 with respect to each other is lower than a stiffness of the pivot connection of the basic suspension member 9 to the holder 8. Hence, the momentum needed to rotate the end suspension member 10 is much lower than the momentum needed to rotate the basic suspension member 9. An advantage of this fact appears to be that a good contour following performance is obtained at two levels, namely at the level of an area of relatively small curvature changes and at the level of an area of relatively large curvature changes, wherein the end suspension member 10 is primarily the member which allows for coverage of the first area, and wherein the basic suspension member 9 is primarily the member which allows for coverage of the latter area.

Another factor contributing to contour following is to have a tilting axis which is closer to skin level. In the shown example, the tilting axis d of the end suspension ring 10 with respect to the basic suspension ring 9 is closer to skin level than the tilting axis c of the basic suspension ring 9 with respect to the holder 8. On the basis of this fact, contour following is improved with respect to a situation in which there is only a basic suspension ring 9, i.e. the end suspension ring 10 is omitted. When a tilting axis is closer to skin level, the extent to which the external cutting member 5 slides over the skin during a rotation of the member 9, 10 tilting about the tilting axis is reduced, and the sensitivity to friction forces is reduced as well.

The tilting axes c, d of the various suspension members 9, 10 may be parallel, as is the case in the shown example, but may also have a mutually different orientation, even perpendicular to one another. Another possibility is that there are more than two suspension members 9, 10, wherein an end suspension member 10 and an underlying intermediate suspension member may be tiltable in perpendicular directions. When pivot connections are realized in various directions, the capability of contour following in the various directions is obtained, which is improved contour following with respect to a situation of movability in fewer directions.

Figure 5:
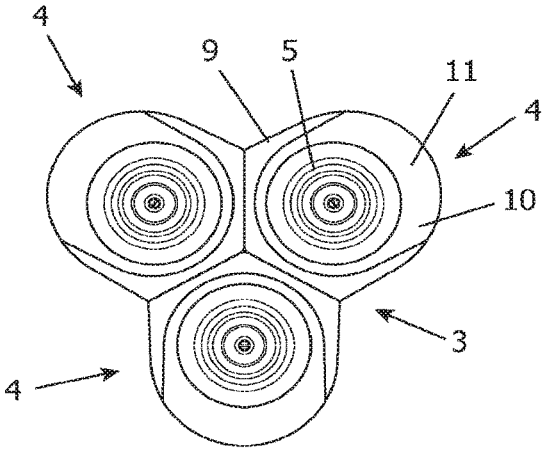
FIGS. 5 and 6 diagrammatically show views of an alternative shaving head, in which an end suspension member of the cutting units is adapted to cover a portion of a basic suspension member.
Figure 6:
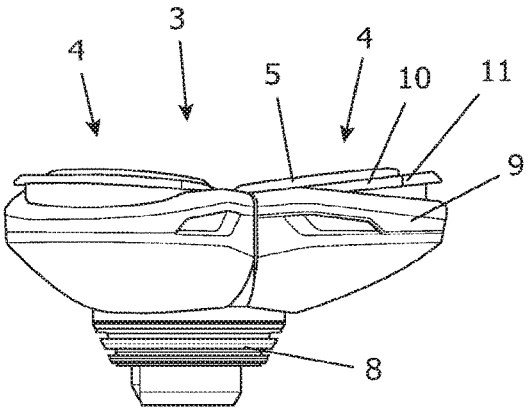

FIGS. 5 and 6 show a first alternative design of the cutting units 4. When compared to the design of the cutting units 4 shown in FIGS. 2-4, the shape of the end suspension member 10 has changed. In particular, a portion 11 of the end suspension member 10 is shaped such as to cover a portion of the underlying basic suspension member 9, as seen from a side where contact between the cutting units 4 and the skin is to take place. In the shown example, this portion 11 is a portion which is at a side of the end suspension member 10 facing away from the centre of the shaving head 3.

With the alternative design of the end suspension member 10, the way in which the feel of the shaving units 4 is experienced by a user of the shaving device 1 is improved. The reason is that with the enlarged portion 11 of the end suspension member 10, a smooth skin contacting surface is realized, wherein a length of a transition between the end suspension member 10 and the basic suspension member 9 is covered and thereby prevented from contacting skin. In that way, the possibility of a smooth gliding of the external cutting members 5 and the surrounding structures over the skin is enhanced.

Figure 7:
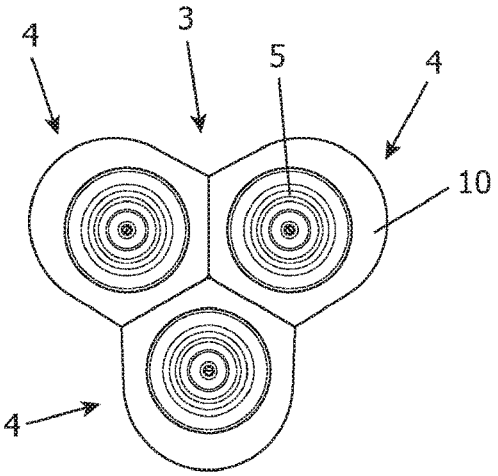
FIGS. 7, 8 and 9 diagrammatically show views of another alternative shaving head, in which an end suspension member of the cutting units is adapted to completely cover a basic suspension member.
Figure 8:
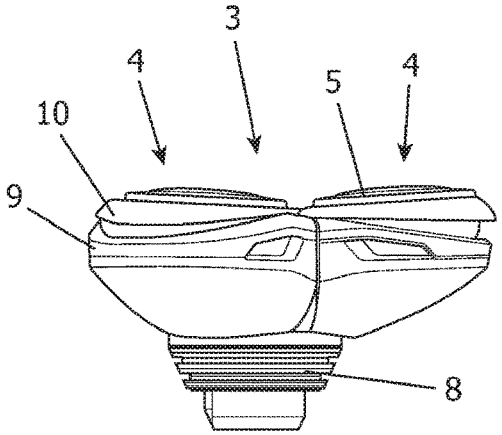
Figure 9:
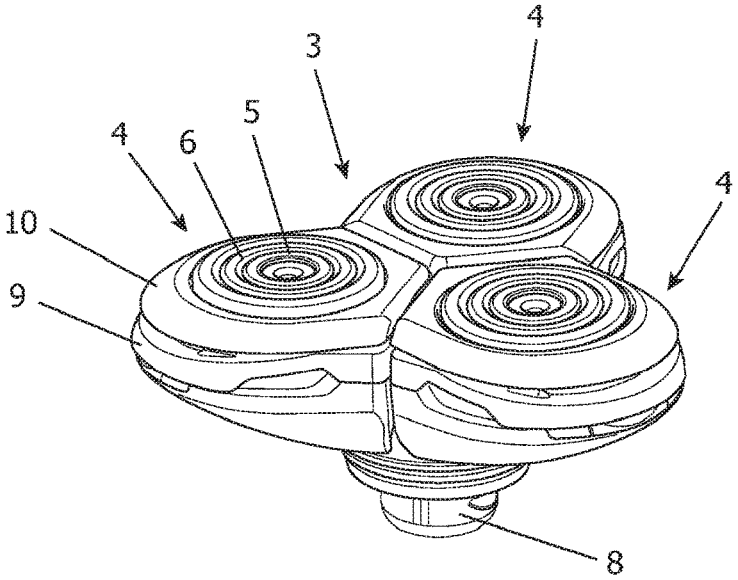

FIGS. 7, 8 and 9 show a second alternative design of the cutting units 4. According to this design, the end suspension member 10 is capable of completely covering the basic suspension member 9, so that there is no longer a transition between the suspension members 9, 10 where contact to the skin may take place.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the Figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the Figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

It is noted that the designs of a cutting unit 4 of the shaving device 1 according to the present invention as shown in the Figures, i.e. designs with suspension members 9, 10 comprising rings in a concentric arrangement, allow for a compact structure of the cutting unit 4. Nevertheless, other shapes and configurations of the suspension members 9, 10 are feasible as well, as long as these members 9, 10 are capable of constituting a connection between the holder 8 and the external cutting member 5, wherein there is a pivot connection both at the location of the connection of the suspension members 9, 10 to the holder 8 and at the location where two suspension members 9, 10 are connected to each other, and wherein a pivoting stiffness of the latter connection is lower than a pivoting stiffness of the first connection. When the suspension means of the shaving unit 4 comprise more than two suspension members, it is important that a stiffness of a pivoting arrangement of a suspension member is lower at a level which is further away from the holder 8 of the shaving device 1 than at a level which is closest to the holder 8.

For the sake of completeness, it is noted that the cutting units 4 may be arranged such as to be detachable with respect to the body portion 2 of the shaving device 1. For example, it may be possible for a user to remove the entire shaving head 3 from the body portion 2 for cleaning purposes, wherein the connection between the holder 8 of the shaving head 3 and the body portion 2 may be realized in any suitable manner for allowing easy detachment and attachment.

In a shaving device 1 comprising more than one cutting unit 4, it is possible for the pivoting stiffness of pivot constructions to vary from cutting unit 4 to cutting unit 4. In other words, the pivoting stiffness of the pivot constructions of one cutting unit 4 does not necessarily need to be the same as the pivoting stiffness of similar pivot constructions of another cutting unit 4. Nevertheless, in a shaving device 1, it is preferred that all cutting units 4 are constructed according to the present invention, namely in such a way that a stiffness of a pivoting arrangement of a suspension member of the cutting unit 4 is lower at a level which is further away from a holder 8 of the shaving device 1 than at a level which is closest to the holder 8, as has been explained in the foregoing.

The present invention can be summarized as follows. A shaving head 3 for use in a shaving device 1 comprises at least one cutting unit 4 in which an external cutting member 5 and an internal cutting member are arranged. In particular, the internal cutting member is movably arranged, and the internal cutting member is adapted to perform a cutting action on hairs when moving with respect to the hairs. The external cutting member 5 serves for contacting skin to be subjected to a shaving action, and allowing hairs to pass from the skin to the internal cutting member. To this end, the external cutting member 5 may be shaped like a cap covering the internal cutting member, which cap is provided with openings 7.

In addition to the cutting unit 4, the shaving head 3 comprises a holder 8 for mounting the cutting unit 4 on a body portion 2 of a shaving device 1. For the purpose of suspending the external cutting member 5 relative to the holder 8, suspension means are provided. According to the present invention, the suspension means comprise at least two pivot constructions, wherein one pivot construction enables a member of the suspension means to be pivotable relative to the holder, and wherein another pivot construction enables the external cutting member to be pivotable relative to the suspension member as mentioned. Furthermore, a pivoting stiffness of a connection of the latter pivot construction is lower than a pivoting stiffness of the first pivot construction.

On the basis of the features of the suspension means as mentioned, skin contour following is improved, wherein good contour following performance is obtained at two levels, namely at the level of an area of relatively small curvature changes and at the level of an area of relatively large curvature changes.

The invention claimed is:

1. A shaving head for use in a shaving device for removing hairs from skin by cutting through the hairs, said shaving head comprising at least one cutting unit and a holder configured to hold the at least one cutting unit, said holder being adapted to be mounted on a body portion of the shaving device, said body portion being configured to be held by a user of the shaving device and being adapted to accommodate one or more members of the shaving device;

where the at least one cutting unit comprises an external cutting member having a surface configured to contact skin during a shaving action and having openings configured to allow hairs to pass;

where the at least one cutting unit further comprises an internal cutting member, said internal cutting member being drivable for movement along the openings in the surface of the external cutting member and being adapted to cut through hairs during such movement; and where the external cutting member is suspended relative to the holder through a suspension assembly comprising:

a first suspension member being tiltable with respect to the holder about a tilting axis (c), the tilting axis (c) extending into a circumferential area of the at least one cutting unit at a side of the at least one cutting unit, said side being proximal to a central axis of the shaving head; and a second suspension member being tiltable with respect to the first suspension member about a tilting axis (d), where said tilting axis (d) extends in a direction relative to said tilting axis (c) for enabling tilting of the second suspension member cooperatively with said first suspension member;

where the first and second suspension members have respective first and second pivoting stiffness threshold values that need to be exerted to effect a tilting movement about respective ones of the tilting axes (c) and (d), the threshold value for effecting tilting of the second suspension member about axis (d) being lower than the threshold value for effecting tilting of the first suspension member about the axis (c), and where the external cutting member of the at least one cutting unit is mounted to the second suspension member.

2. The shaving head of claim 1, where the first and second suspension members comprise concentrically-arranged rings.

3. The shaving head of claim 2, where when viewed from a side thereof facing skin to be contacted by the at least one cutting unit, the first suspension member underlies the second suspension member and the second suspension member covers at least a portion of the first suspension member, such that the covered portion is prevented from contacting said skin.

4. The shaving head of claim 1, where the tilting axes (c) and (d) extend at mutually different first and second levels with respect to the skin-contacting surface of the external cutting member.

5. The shaving head of claim 4, where the tilting axis (c) extends at the first level with respect to the skin-contacting surface of the external cutting member and the tilting axis (d) extends at the second level with respect to said skin-contacting surface of said external cutting member, said first level being further away than said second level from the skin-contacting surface of the external cutting member.

6. The shaving head of claim 1, where tilting axis (c) extends substantially parallel to tilting axis (d).

7. The shaving head of claim 1, where the internal cutting member is rotatably arranged.

8. The shaving device of claim 1, where the holder is adapted to allow for pivotal movements with respect to said body portion about one of a tilting axis (a) and a tilting axis (b) and where the tilting axis (c) extends substantially parallel to said one of tilting axis (a) and tilting axis (b) of the holder.

9. A shaving device for removing hairs from skin by cutting through the hairs, comprising:

a body portion configured to be held by a user of the shaving device and being adapted to accommodate one or more members of the shaving device; and a shaving head comprising at least one cutting unit and a holder configured to hold the at least one cutting unit, said holder being adapted to be mounted on the body portion of the shaving device;

where the at least one cutting unit comprises an external cutting member having a surface configured to contact skin during a shaving action and having openings configured to allow hairs to pass;

where the at least one cutting unit further comprises an internal cutting member, said internal cutting member being drivable for movement along the openings in the surface of the external cutting member and being adapted to cut through hairs during such movement; and where the external cutting member is suspended relative to the holder through a suspension assembly comprising:

a first suspension member being tiltable with respect to the holder about a tilting axis (c), the tilting axis (c) extending into a circumferential area of the at least one cutting unit at a side of the at least one cutting unit, said side being proximal to a central axis of the shaving head; and a second suspension member being tiltable with respect to the first suspension member about a tilting axis (d), where said tilting axis (d) extends in a direction relative to said tilting axis (c) for enabling tilting of the second suspension member cooperatively with said first suspension member;

where the first and second suspension members have respective first and second pivoting stiffness threshold values that need to be exerted to effect a tilting movement about respective ones of the tilting axes (c) and (d), the threshold value for effecting tilting of the second suspension member about axis (d) being lower than the threshold value for effecting tilting of the first suspension member about the axis (c).

10. The shaving device of claim 9, where the shaving head comprises at least two cutting units.

11. The shaving device of claim 9 where the holder is adapted to allow for pivotal movements with respect to said body portion about one of a tilting axis (a) and a tilting axis (b) and where the tilting axis (c) extends substantially parallel to one of said tilting axis (a) and said tilting axis (b) of the holder.

12. A shaving head for use in a shaving device for removing hairs from skin by cutting through the hairs, said shaving head comprising at least one cutting unit and a holder configured to hold the at least one cutting unit, said holder being adapted to be mounted on a body portion of the shaving device, said body portion being configured to be held by a user of the shaving device and being adapted to accommodate one or more members of the shaving device;

where the at least one cutting unit comprises an external cutting member having a surface configured to contact skin during a shaving action and having openings configured to allow hairs to pass;

where the at least one cutting unit further comprises an internal cutting member, said internal cutting member being drivable for movement along the openings in the surface of the external cutting member and being adapted to cut through hairs during such movement; and where the external cutting member is suspended relative to the holder through a suspension assembly comprising:

a first suspension member being tiltable with respect to the holder about a tilting axis (c), the tilting axis (c) extending into a circumferential area of the at least one cutting unit at a side of the at least one cutting unit, said side being proximal to a central axis of the shaving head; and a second suspension member being tiltable with respect to the first suspension member about a tilting axis (d), where said tilting axis (d) is parallel to said tilting axis (c);

said first and second suspension members having respective first and second pivoting stiffness threshold values that need to be exerted to effect a tilting movement about respective ones of the tilting axes (c) and (d), the threshold value for effecting tilting of the second suspension member about axis (d) being lower than the threshold value for effecting tilting of the first suspension member about the axis (c).

13. A shaving head for use in a shaving device, said shaving head comprising at least one cutting unit and a holder configured to hold the at least one cutting unit, said holder being adapted to be mounted on a body portion of the shaving device, said body portion being configured to be held by a user of the shaving device and being adapted to accommodate one or more members of the shaving device;

where the at least one cutting unit comprises an external cutting member having a first surface configured to contact skin during a shaving action, having openings configured to allow hairs to pass and having a second surface opposite the first surface, the second surface being configured to cooperate with an internal cutting member to cut through hairs during such cooperation; and where the external cutting member is suspended relative to the holder through a suspension assembly comprising:

a first suspension member being tiltable with respect to the holder about a tilting axis (c), the tilting axis (c) extending into a circumferential area of the at least one cutting unit at a side of the at least one cutting unit, said side being proximal to a central axis of the shaving head; and a second suspension member being tiltable with respect to the first suspension member about a tilting axis (d), where said tilting axis (d) extends in a direction relative to said tilting axis (c) for enabling tilting of the second suspension member cooperatively with said first suspension member;

where the first and second suspension members have respective first and second pivoting stiffness threshold values that need to be exerted to effect a tilting movement about respective ones of the tilting axes (c) and (d), the threshold value for effecting tilting of the second suspension member about axis (d) being lower than the threshold value for effecting tilting of the first suspension member about the axis (c), and where the external cutting member of the at least one cutting unit is mounted to the second suspension member.

* * * * *